United States Patent [19]

Ross

[11] 3,988,904

[45] Nov. 2, 1976

[54] REFRIGERATION SYSTEM

[75] Inventor: Robert R. Ross, Wheaton, Ill.

[73] Assignee: H. A. Phillips & Co., St. Charles, Ill.

[22] Filed: Dec. 5, 1974

[21] Appl. No.: 529,856

[52] U.S. Cl. ..... 62/174; 62/509; 62/DIG. 17

[51] Int. Cl.[2] ..... F25B 45/00

[58] Field of Search ..... 62/174, 149, 510, 509, 62/512, 77, 292, DIG. 17

[56] References Cited

UNITED STATES PATENTS

| | | | |
|---|---|---|---|
| 1,944,472 | 1/1934 | Sloan | 62/512 |
| 2,724,240 | 11/1955 | Sloan | 62/174 |
| 2,841,962 | 7/1958 | Richards | 62/175 |
| 2,871,673 | 2/1959 | Richards | 62/509 |
| 2,931,191 | 4/1960 | Watkins | 62/174 |
| 2,949,750 | 8/1960 | Kramer | 62/DIG. 17 |
| 2,966,043 | 12/1960 | Ross | 62/218 |
| 2,986,898 | 6/1961 | Wood | 62/512 |
| 3,315,484 | 4/1967 | Ross | 62/174 |
| 3,487,656 | 1/1970 | Grant | 62/174 |

*Primary Examiner*—William E. Wayner

*Attorney, Agent, or Firm*—Hume, Clement, Brinks, Willian, Olds & Cook, Ltd.

[57] ABSTRACT

A refrigeration system incorporating a compressor sub-system which provides a source of higher pressure gaseous refrigerant to force liquid refrigerant into the receiver when condensor pressure is reduced sufficiently below normal to prevent it accomplishing the same purpose. When condensor pressure is insufficient to force liquid refrigerant from a pilot receiver tank to the receiver tank liquid accumulates in the pilot receiver tank to a level where it actuates a control valve, introducing said higher pressure gaseous refrigerant to said pilot tank and forcing liquid out. While condensor pressure is sufficient to the task, as is normally the case, the higher pressure gaseous refrigerant is received directly by the condensor.

3 Claims, 1 Drawing Figure

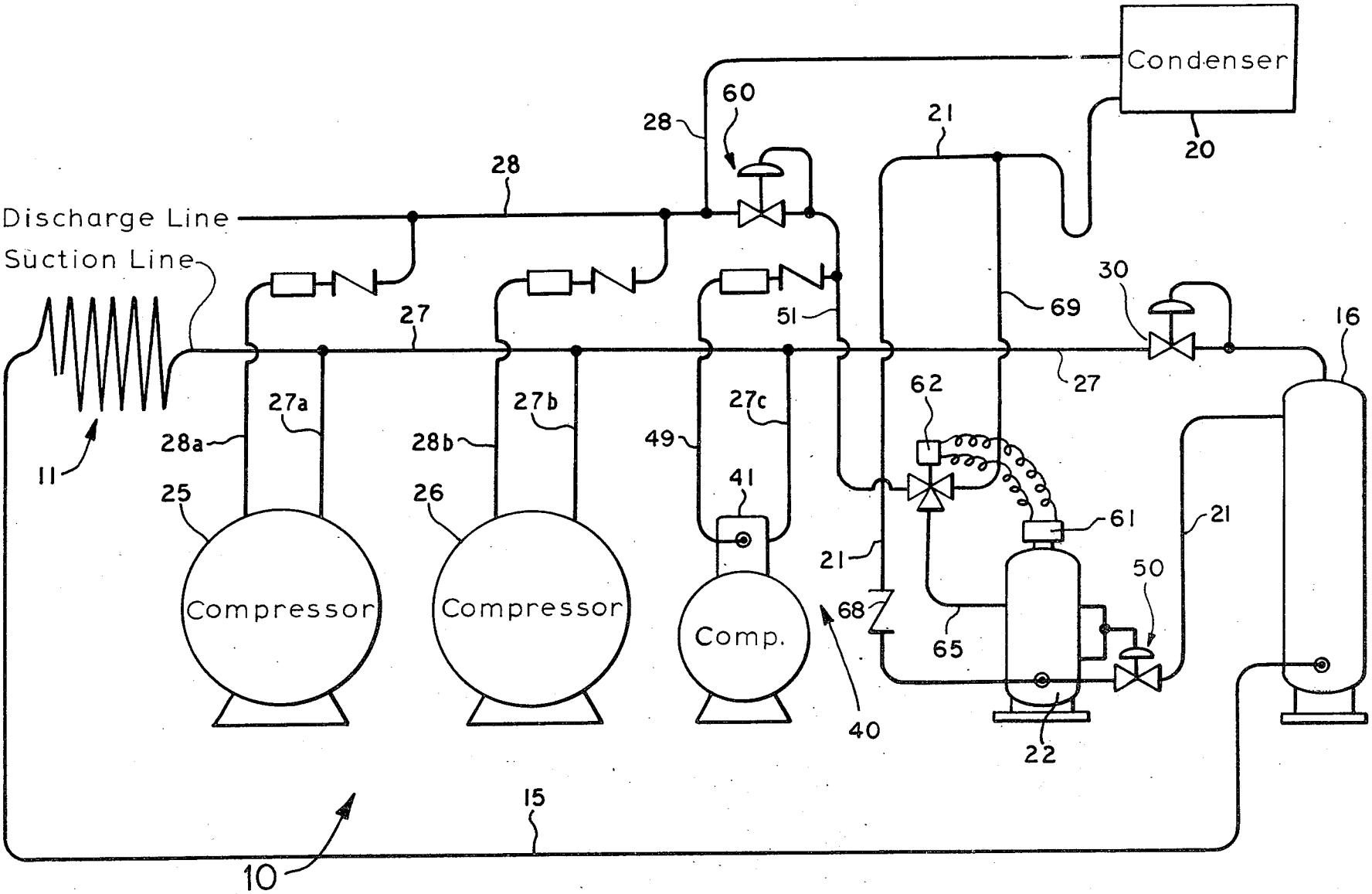
Condenser
20
16
21
30
50
61
27
69
22
21
62
65
68
40
51
60
27c
41
Comp.
28
49
27b
Compressor
28
28b
26
15
27
27a
Compressor
28a
25
10
Discharge Line
Suction Line
11

REFRIGERATION SYSTEM

FIELD OF THE INVENTION

This invention is in the field of refrigeration. It relates more particularly to refrigeration systems of a large, industrial type.

BACKGROUND OF THE INVENTION

H. A. Phillips & Co. of Chicago, Illinois, assignee of this application, has long been a leader in the design, development and installation of industrial refrigeration systems. A pioneer in recirculating systems, its engineers have constantly sought new and improved refrigeration systems and equipment of this type. Systems and components for refrigeration which have been developed at Phillips include those covered by Phillips U.S. Pat. No. 2,570,979; Phillips U.S. Pat. No. 2,589,859; Phillips U.S Pat. No. 2,641,281; Richards U.S. Pat. No. 2,841,962; Richards et al. U.S. Pat. No. 2,871,673; and Ross U.S Pat. No. 2,966,043.

These systems, as well as others in the prior art, provided excellent operational results in terms of refrigeration through both winter and summer, nightime and daytime operation. However, wide variations in ambient temperature do effect the efficiency of most known systems in an undesirable manner. Higher power usage and costs are the normal result.

SUMMARY OF THE INVENTION

An object of the present invention is to provide a refrigeration system incorporating means which permits operating with a system liquid pressure higher than normal condensor pressures. As a result, the condensor is permitted to operate at as low pressures as possible, dictated by air and water temperatures, effecting substantial savings in the main compressor motor usage. This not only reduces the brake horsepower per ton used but reduces wearing forces and prolongs the service life of the compressor, particularly in reciprocating machines.

The objects of the invention are realized by providing a source of higher pressure gaseous refrigerant in the system. This is accomplished in the preferred embodiment with a compressor sub-system. A compressor in the sub-system operates whenever the condensor pressure in the main system is less than about 5 psi above the desired plant feed pressure. Where the desired plant feed pressure is 125 psi, for example, and the system pressure is above 125–130 psi, the capacity of the auxiliary compressor running at 140 psi is effectively used in refrigeration.

BRIEF DESCRIPTION OF THE DRAWING

The present invention, including its construction and method of operation, is illustrated schematically in the drawing.

DESCRIPTION OF THE PREFERRED EMBODIMENT

Referring now to the drawing, a refrigeration system embodying features of the invention is illustrated schematically at 10. The system 10 is designed to provide highly efficient refrigeration in an industrial plant, for example, through the medium of an evaporator unit 11 which receives liquid ammonia refrigerant. The system 10 provides highly efficient operation in both winter and summer.

The evaporator unit 11 receives liquid through the line 15 from a controlled pressure receiver tank 16. The receiver tank 16, in turn, receives liquid refrigerant from the condensor 20 through a line 21 in which a pilot receiver tank 22 is interposed.

Vaporized refrigerant is returned to the compressors 25 and 26 from the evaporator unit 11 through the line 27 and branch lines **27*a* and 27*b*. The compressors 25 and 26, in turn, compress the gaseous refrigerant and supply this compressed gaseous refrigerant to the condenser 20 through the discharge lines 28*a* and 28*b* which are teed into the discharge line 28.**

Up to this point, a basically conventional refrigerating system has been described. Under normal operating conditions, the condensor 20 is designed to operate at a pressure of approximately 155 psi. Pressure in the receiver 16 is controlled by conventional pressure control valve 30 so that it does not rise above 125 psi.

The present invention is embodied in a system 10 which maximizes its efficiency under conditions where the pressure in the system would normally fall below normal operating pressure; i.e., in the winter or at night, for example. According to the invention, the system 10 maintains a substantially constant pressure in the refrigeration system which is higher than normal winter or nightime condensor pressure but lower than normal summer condensor pressures. This is achieved, regardless of ambient temperature, by utilizing a compressor sub-system 40 which cooperates with the system 10 according to the invention.

In operation, assume the optimum pressure in the receiver tank 16 or system is 125 psi, as has been pointed out. The normal pressure in the condensor is about 155 psi, as has also been pointed out.

As long as the condensor pressure is above 125 psi, no supplemental or auxiliary pressure is required to transfer liquid from the pilot receiver tank 22 through the line 21 to the receiver tank 16. Condensed liquid refrigerant is forced through the pilot receiver tank 22 to the receiver tank 16 without the use of the sub-system 40. A conventional level control valve unit 50 constantly regulates liquid accumulation in tank 22 and removal to tank 16. When the pressure in the condensor 20 falls to 125–130 psi or below in winter or nightime operation, however, the operation of the sub-system 40 is utilized according to the invention to force liquid refrigerant from the pilot receiver tank 22 into the receiver tank 16.

The sub-system 40 includes another compressor 41 which receives vaporized refrigerant through the branch line 27c from the return line 27 connected to the vaporizer unit 11. The compressor 41 compresses this gaseous refrigerant and supplies it through the line 50 to the line 51 into which the line 49 is teed.

The line 51 is, in turn, teed into line 28, as illustrated, through a pressure control valve 60. The pressure control valve 60 does not permit pressure in the line 51 to build-up above 140 psi. It is effective to achieve this end by bleeding refrigerant gas under pressure from the line 51 when pressure in this line builds up to and above 140 psi. The valve 60 opens as required to maintain this set pressure.

Normally, the compressor 41 is operating with its output shunted entirely into the line 28. Regardless of what happens in the line 28, however, the pressure in line 49 and 51 does not fall below 140 psi. When condensor 20 pressure falls off in the aforedescribed manner, the pressure in line 51 is used to transfer liquid from tank 22 to tank 16. This is accomplished as follows.

Because the condensor 20 pressure has fallen, the liquid level in receiver tank 22 rises because there is insufficient pressure in the line 21 to discharge the liquid into the receiver tank 16. When the liquid level in the tank 22 rises to a predetermined upper level, a float switch 61 is actuated. The float switch 61 operates the three-way valve 62 to open the port connecting line 51 with line 65. Auxiliary compressor pressure of 140 psi is thus effective in the pilot receiver tank 22 and forces liquid from the tank 22 out of the tank, through the line 21 into the receiver tank 16.

During the time required for emptying the pilot receiver tank 22 in this manner, liquid draining from the condensor 20 accumulates in the line 21 above the check valve 68. After the liquid in tank 22 has been lowered to a predetermined lower level, the three-way valve 62 is switched by the float control switch 61 to close the port connecting the lines 51 and 65. The port connecting line 65 with line 69 is opened and the tank 22 is vented back to above the gas trap in the line 21 so that liquid can flow from line 21 into the receiver tank 22 once again.

It will now be seen that the capacity of the compressor 41 in the sub-system 40, running at 140 psi minimum head pressure, is effectively used in the refrigeration system 10 so that only the additional horsepower which the pressure 41 itself uses during low head operation must be counted as the cost of operating the compressor sub-system. Meanwhile, of course, the main compressor power use is reduced dramatically. The head pressure in the compressors 25 and 26, for example, is reduced from approximately 130 psi to in the neighborhood of 95 psi. This reduces the power required by about 23 percent.

While these savings cannot be sustained year around, the annual power savings on the main compressors have been found to more than pay for the sub-system 40, particularly in temperate zones. The compressor 41 utilizes far less power than is saved by more efficient operation of the main compressors.

While the embodiment described herein is at present considered to be preferred, it is understood that various modifications and improvements may be made therein, and it is intended to cover in the appended claims all such modifications and improvements as fall within the true spirit and scope of the invention.

What is desired to be claimed and secured by Letters Patent of the United States is:

1. A refrigeration system, comprising:

a. compressor means for compressing vaporized refrigerant received from evaporator means, b. condensor means for receiving compressed refrigerant gas from said compressor means and removing heat from said gas to liquify all or a portion of it.

c. receiver tank means for receiving said liquified refrigerant from said condensor means and delivering it to said evaporator means at a predetermined system pressure, d. the pressure in said condensor means normally being above said predetermined pressure and being effective then to force liquid refrigerant into said receiver tank means, e. pressure means actuated when said condensor pressure falls to about or below said predetermined system pressure and effective, when actuated, to force liquified refrigerant from said condensor means into said receiver tank means, f. said pressure means comprising a compressor which functions solely to compress vaporized refrigerant for delivery to said condensor means while the pressure in said condensor means is approximately at or above said predetermined pressure, and g. a pilot receiver tank provided between said condensor means and said receiver tank means for collecting liquid refrigerant enroute to said receiver tank means, h. condensed refrigerant accumulating in said pilot receiver tank means to a higher liquid level than normal when the pressure in said condensor means falls approximately to or below said predetermined pressure whereupon a valve in said system is actuated to cause refrigerant gas under pressure to be directed from said compressor into said pilot receiver tank to force liquid accumulated therein into said receiver tank means.

2. The system of claim 1 further characterized in that:

a. said compressor is connected to the inlet of said condensor means by a pressure control valve wherein pressure in excess of normal system pressure produced by said compressor is always bled off to said condensor means.

3. A refrigeration system, comprising:

a. compressor means for compressing vaporized refrigerant received from evaporator means, b. condensor means for receiving compressed refrigerant gas from said compressor means and removing heat from said gas to liquify all or a portion of it, c. receiver tank means for receiving said liquified refrigerant from said condensor means and delivering it to said evaporator means at a predetermined system pressure, d. the pressure in said condensor means normally being above said predetermined pressure and being effective then to force liquid refrigerant into said receiver tank means, e. pressure means actuated when said condensor pressure falls to about or below said predetermined system pressure and effective, when actuated, to force liquified refrigerant from said condensor means into said receiver tank means, and f. a pilot receiver tank provided between said condensor means and said receiver tank means for collecting liquid refrigerant enroute to said receiver tank means, g. said condensed refrigerant accumulating in said pilot receiver tank means to a higher liquid level than normal when the pressure in said condensor means falls approximately to or below said predetermined pressure, whereupon a valve in said system is actuated to cause refrigerant gas under pressure to be directed into said pilot receiver tank to force liquid accumulated therein into said receiver tank means.

* * * * *

UNITED STATES PATENT OFFICE

CERTIFICATE OF CORRECTION

Patent No. 3,988,904 Dated November 2, 1976

Inventor(s) Robert R. Ross

It is certified that error appears in the above-identified patent and that said Letters Patent are hereby corrected as shown below:

Column 2, line 45, "ime" should read -- time --; line 54, "50" should read -- 49 --.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*